US007404583B1

(12) United States Patent
Hassen

(10) Patent No.: US 7,404,583 B1
(45) Date of Patent: Jul. 29, 2008

(54) METHOD AND DEVICE TO AID TYING OF LACE-UP SHOES

(76) Inventor: Mendy K. Hassen, 1210 Hannington Dr., Katy, TX (US) 77460

( * ) Notice: Subject to any disclaimer, the term of this patent is extended or adjusted under 35 U.S.C. 154(b) by 247 days.

(21) Appl. No.: 11/134,694

(22) Filed: May 20, 2005

Related U.S. Application Data

(60) Provisional application No. 60/573,536, filed on May 21, 2004.

(51) Int. Cl.
*B65H 69/04* (2006.01)

(52) U.S. Cl. ..... 289/1.5

(58) Field of Classification Search ..... 289/2, 289/17
See application file for complete search history.

(56) References Cited

U.S. PATENT DOCUMENTS

| | | | | |
|---|---|---|---|---|
| 4,342,557 | A | 8/1982 | Bandar | |
| 4,485,529 | A | 12/1984 | Blum | |
| 4,553,293 | A | 11/1985 | Blum | |
| 4,805,270 | A | 2/1989 | Kimbrough | |
| 4,852,223 | A | 8/1989 | McCreary | |
| 5,372,510 | A | 12/1994 | Stanfield | |
| 5,611,692 | A | 3/1997 | Gehrdes | |
| 5,692,274 | A | 12/1997 | Merser | |
| 5,718,021 | A | 2/1998 | Tatum | |
| 5,884,375 | A * | 3/1999 | Hancock | 24/712.7 |
| 5,927,764 | A | 7/1999 | Harriman | |
| 6,240,607 | B1 * | 6/2001 | McCrary | 24/712.1 |
| 6,701,589 | B1 * | 3/2004 | Kliewer | 24/712 |
| 7,044,508 | B2 * | 5/2006 | Burns et al. | 289/1.5 |
| 2003/0024084 | A1 * | 2/2003 | Liu | 24/712.1 |
| 2005/0252042 | A1 * | 11/2005 | Harrington | 36/132 |
| 2006/0260153 | A1 * | 11/2006 | Stewart White | 36/136 |

OTHER PUBLICATIONS www.gungfu.com/cart-html/accessories_jewelry_keychains.htm (Oct. 15, 2002).*

* cited by examiner

*Primary Examiner*—Shaun R Hurley
(74) *Attorney, Agent, or Firm*—Karen B. Tripp

(57) ABSTRACT

A shoe tying device or apparatus comprising a ring and a method of using same to facilitate the tying of laces in lace-up shoes and also a method of using same. The shoe tying device is lightweight and unobtrusive, allowing the shoe to often stay tied longer than typical without the device while generally maintaining a normal "bow" appearance. Further, the device is economical and reusable. The shoe tying device is particularly helpful for children, the visually impaired, and the mentally and physically handicapped.

2 Claims, 3 Drawing Sheets

METHOD AND DEVICE TO AID TYING OF LACE-UP SHOES

RELATED APPLICATION

This application claims priority to U.S. Provisional Patent Application No. 60/573,536, entitled "Method & Device to Aid Tying of Lace-up Shoes", filed May 21, 2004, and incorporates the content of that provisional application entirely herein by reference.

BACKGROUND OF THE INVENTION

1. Field of the Invention

This invention relates to methods and apparatuses for tying shoes, particularly lace-up shoes.

2. Description of Relevant Art

Children, visually impaired persons, and mentally and physically handicapped persons often have difficulty in tying their shoes. A major difficulty encountered by such persons is holding one end of a shoelace in a loop configuration while manipulating the other end of the shoelace to form a second loop and then wrapping and threading the loops.

Various devices and methods have been proposed for facilitating the tying of shoes or for teaching persons to tie their shoes. However, a need continues to exist for easier devices and methods.

SUMMARY OF THE INVENTION

A shoe tying device or apparatus is provided that facilitates the tying of laces used for fastening or holding together lace-up shoes. The device (or apparatus) is a ring with a central hole or hollow center sufficiently large to receive a shoelace loop. The ring is preferably sufficiently lightweight as not to add any significant or noticeable weight to the shoe and is preferably made of a material that allows the ring to be reused multiple times, preferably for the life of the shoe at least. Most preferably, the ring is comprised of plastic or an invert nylon polymer, and is preferably rigid.

The shoe tying device of the invention is able to facilitate the tying of laces by using the device according to the method of the invention. In the method of the invention, a lace-up shoe that has been at least partially or completely laced with a lace that has unlaced ends that have not yet been tied is provided. In the first step, the unlaced ends of the shoelace are overlapped or crisscrossed, generally or preferably approximating the shape of an "X" with the ends of the lace. Second, the top end of the lace is crossed over, under and through the bottom end of the lace and pulled tightly. Third, a first loop is made with one end of the lace and a first ring is slid over the first loop and slid down the loop to the bottom of the loop near the shoe. Next, without manually holding the first loop, that is, while allowing the first ring to hold the first loop, a second loop is made with the other end of the lace and a second ring is slid over the second loop and slid down the loop to the bottom of the loop near the shoe. In the next step, the two loops are crisscrossed or overlapped, generally or preferably approximating an "X" shape. The top loop is then crossed over, under and through the other loop and pulled tight to yield a tie or bow. The shoe tying device preferably remains on the tie or bow to help secure it. However, in an alternative embodiment, each ring has one or more slits to facilitate removal of the rings from the tie or bow after the shoe is tied.

In another alternative embodiment, the rings are attached to the shoes before the method of the invention is applied. Preferably, a flexible plastic string such as for example fishing line is attached to the ring and to the shoe in such a manner as not to interfere with the tying of the shoe. That is, the string should be sufficiently long to allow manipulation of the ring but not so long as to interfere with the tie or to drag the ground. This embodiment is believed to be especially helpful to the visually impaired and may be incorporated with other shoe features developed for the visually impaired.

DETAILED DESCRIPTION OF PREFERRED EMBODIMENTS

Figure 11:
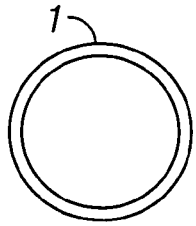
FIG. 11 is a sketch of the top view of the device of the invention.

FIGS. 1-10 illustrate in schematic form the basic steps of the preferred embodiment of the invention using the preferred apparatus of the invention in facilitating the tying of lace-up shoes. FIGS. 5-10 show the shoe tying device 1 (or apparatus) of the invention in use. As shown in FIG. 11, the device 1 is a ring, preferably round or circular, with a central hole 2 or hollow center sufficiently large to receive a looped shoelace. In an alternative embodiment, the ring may have a slit or be "broken" so that the device may be removed from the shoelace after use in tying. Otherwise, the ring may remain on the shoe and shoelace unobtrusively, or as a decorative element depending on color and/or shape, after tying.

A preferred size for the ring of device 1 is less than about one inch in diameter, and most preferably about five-eighth inch in diameter, with the central hole about three-eighth inch to about one-half inch in diameter, although any size might be used that does not interfere with tying of the shoelaces or with a person's walking in the shoe and that affords a hole (preferably in the center) sufficiently large to receive a looped shoelace. However, ties made using larger sizes of the device of the invention, such as device sizes exceeding about one inch, tend to come untied more quickly, whereas ties made using the preferred size of device 1 tend to stay tied longer than ties made without the device.

The device 1 is preferably rigid, preferably about one-eighth inch in thickness, and preferably sufficiently lightweight as to not add weight to the shoe. A preferred weight is less than about five grams. Plastic or an inert nylon polymer is a preferred material for the device 1, but other materials such as cardboard or metal for example could alternatively be used. Most preferably, device 1 will be made of a material that will allow the device 1 to be reused multiple times.

It should be understood that the configurations of the device of the invention shown in FIGS. 5-11 and described herein are merely those of a preferred embodiment. Other configurations may be used, such as configurations with portions of artistic design or rings that are elongated or ovals rather than circular or that are triangular, rectangular or square in shape, or even irregular in shape, so long as such rings have holes, preferably central holes, for receiving the shoelace loops. Some such alternative configurations work better than others, however, and the circular or "o-ring" configuration of the device is most effective.

Figure 1:
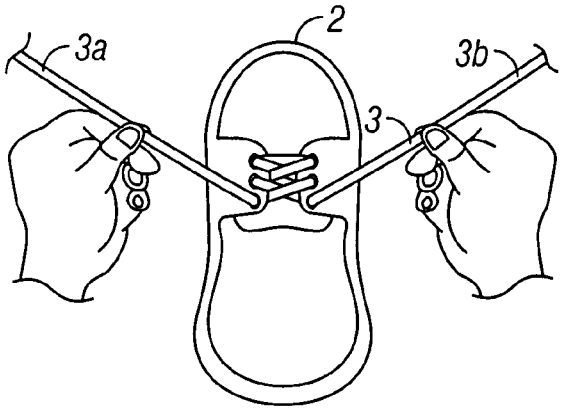
FIG. 1 is a schematic top view of the starting point for application of the method of the invention as applied to tying a lace-up shoe.
Figure 2:
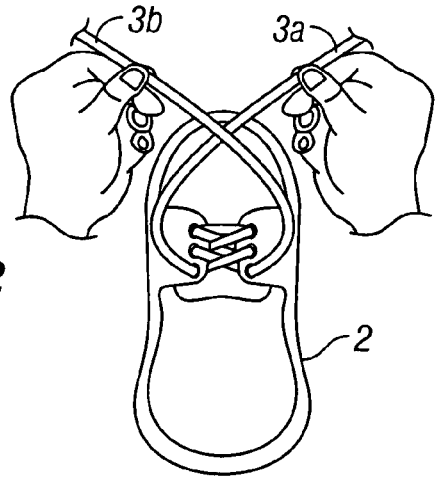
FIG. 2 is a schematic top view of the first step in the method of the invention as applied to tying a lace-up shoe.
Figure 3:
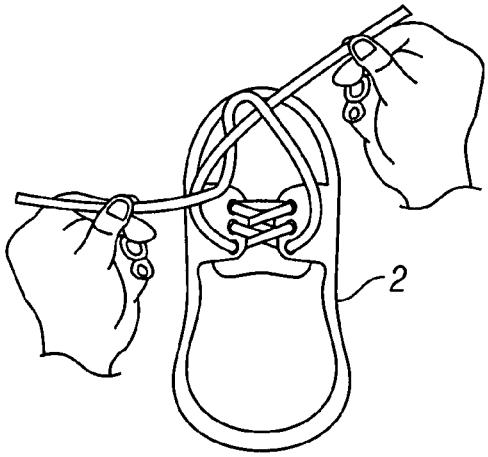
FIG. 3 is a schematic top view of the first portion of the second step in the method of the invention as applied to tying a lace-up shoe.
Figure 4:
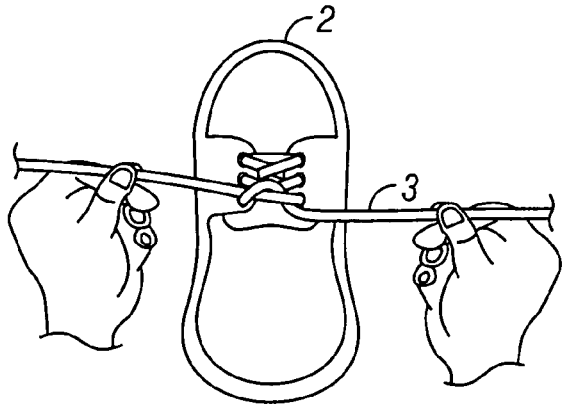
FIG. 4 is a schematic top view of the last portion of the second step in the method of the invention as applied to tying a lace-up shoe.
Figure 5:
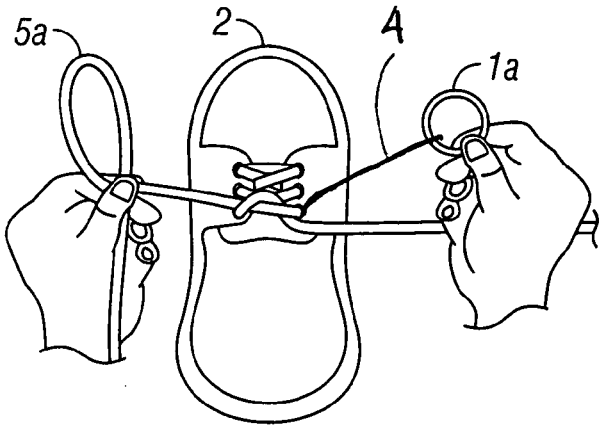
FIG. 5 is a schematic top view of the first portion of the third step in the method of the invention as applied to tying a lace-up shoe.
Figure 6:
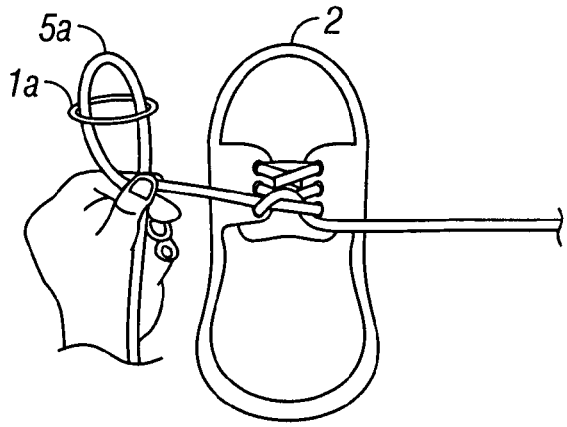
FIG. 6 is a schematic top view of the last portion of the third step in the method of the invention and of the fourth step in the method of the invention as applied to tying a lace-up shoe.
Figure 7:
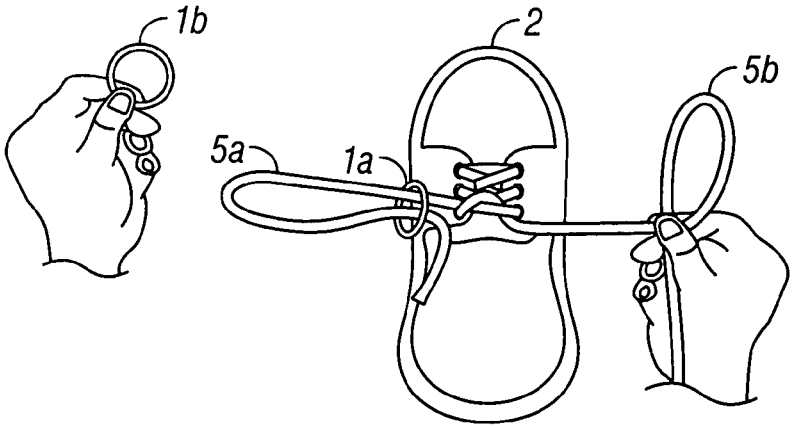
FIG. 7 is a schematic top view of the fifth step in the method of the invention as applied to tying a lace-up shoe.
Figure 8:
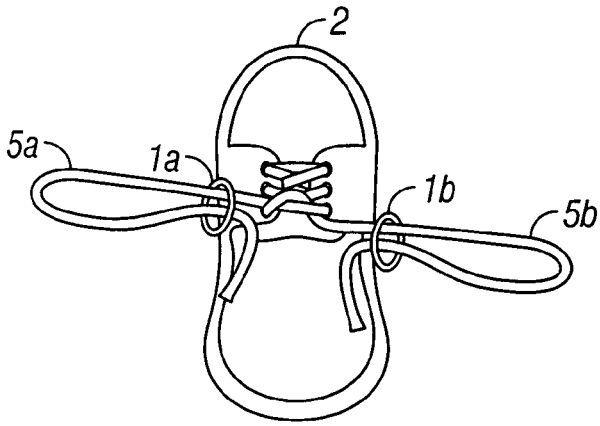
FIG. 8 is a schematic top view of the results of the sixth step in the method of the invention as applied to tying a lace-up shoe.
Figure 9:
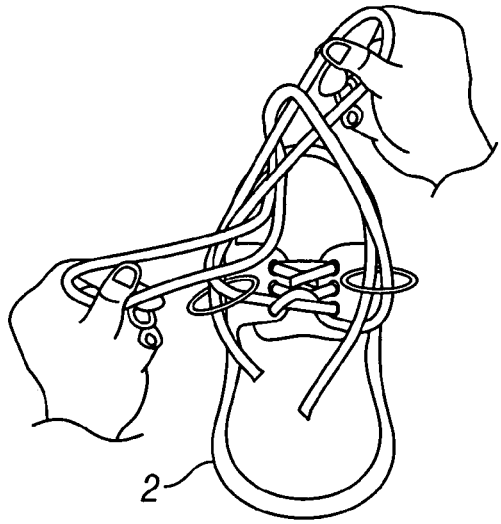
FIG. 9 is a schematic top view of the seventh step in the method of the invention as applied to tying a lace-up shoe.
Figure 10:
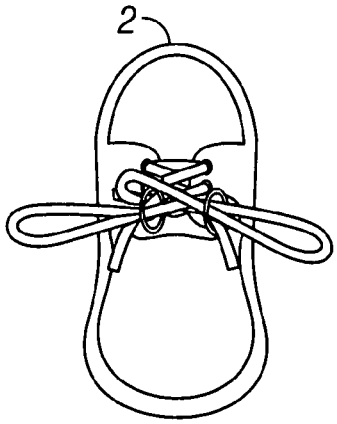
FIG. 10 is a schematic top view of the eighth step in the method of the invention as applied to tying a lace-up shoe.

Device 1 is shown as a separate ring in FIG. 11, and in FIG. 7 as ring 1*b*, that is, as a ring not attached to the shoe 2. However, in an alternative embodiment, the device 1 could be attached to the shoe at any time before beginning the method of the invention of using the device 1 to facilitate tying of the shoe. A preferred way to attach device 1 to the shoe 2 is with a flexible, lightweight, and strong plastic string 4 such as fishing line, or other material that is not easily tangled or knotted, as shown in FIG. 5. Such string is attached on one end to device 1, such as by wrapping and tying and/or knotting or otherwise securing the string around a portion of the device 1 and through the central hole, and on the other end to the shoe, such as by threading and knotting the string through an eyelet of the shoe which may or may not also contain a shoelace. Preferably this attachment string will be sufficiently long as to allow manipulation of the device 1 but not so long as to interfere with the tie or to drag the ground. Preferably, the portion of the attachment string between the ring and the shoe will not exceed about four to five inches in length and will be at least about two inches in length. The string or other attachment of the device 1 to the shoe is particularly helpful for the visually impaired or blind, because it enables the shoe wearer to more easily find and use the device 1.

The device 1 is able to facilitate or aid tying of shoes by using the device 1 according to the method of the invention. Referring to FIGS. 1-10, a laced-up but untied shoe 2, or a shoe 2 with at least one pair of eyelets and a shoelace 3 threaded through the eyelets but left untied, is provided to start. In the first step of the method of the invention, the unlaced ends 3*a* and 3*b* of the shoelace 3 are overlapped or crisscrossed, generally or preferably approximating the shape of an "X" with the ends 3*a* and 3*b* of the lace 3. Next, the top end of the lace 3 is crossed over, under and through the bottom end of the lace and pulled tightly. Then, a first loop 5*a* or "bunny ear" preferably about four inches long is made with one end of the lace 3. Device 1 of the invention, a first ring 1*a*, is slid over the first loop 5*a* and slid down the loop 5*a* to the bottom of the loop 5*a* near the shoe 2. Next, without manually holding the first loop 5*a*, that is, while allowing the first ring 1*a* to hold the first loop 5*a*, a second loop 5*b* or "bunny ear" preferably about four inches long is made with the other end of the lace 3. A second ring 1*b* is slid over the second loop 5*b* and slid down the loop 5*b* to the bottom of the loop 5*b* near the shoe 2. The two loops 5*a* and 5*b* are crisscrossed or overlapped, generally or preferably approximating an "X" shape. The top loop is then crossed over, under and through the other loop and pulled tight to yield a tie or bow. The device 1 preferably remains on the tie or bow on shoe 2 to help secure the tie. However, in an alternative embodiment, each ring has one or more slits to facilitate removal of the rings from the tie or bow after the shoe is tied.

Although the apparatus and method of the invention using the apparatus are discussed with respect to facilitating the tying of a lace-up shoe, the apparatus and method of the invention may also be used to facilitate tying of laces or tying bows with laces laced to other pieces of clothing, such as for example dresses, or even other materials such as might comprise accessories such as, for example, handbags.

The foregoing description of the invention is intended to be a description of preferred embodiments. Various changes in the details of the described methods and apparatuses can be made without departing from the intended scope of this invention as defined by the appended claims.

I claim:

1. A method for aiding the tying of a shoe laced with a shoelace comprising the steps of:

(a) overlapping or crisscrossing one end of said lace over the other;

(b) crossing the top lace over, under and through the bottom lace, and pulling tight;

(c) making a first loop with one end of the lace and placing a first ring onto said first loop or pulling the loop through a first ring;

(d) sliding the first ring to the bottom of the first loop near the shoe;

(e) making a second loop with the other end of the lace and placing a second ring onto the loop or pulling the second loop through a second ring;

(f) sliding the second ring to the bottom of the second loop near the shoe;

(g) overlapping or crisscrossing the first and second loops;

(h) crossing the top loop over, under and through the bottom loop, and pulling tight, wherein each said ring is attached to said shoe prior to conducting steps (a)-(h).

2. The method of claim 1 wherein said first ring is attached to said shoe with a flexible string on one side of said shoe lacing and said second ring is attached to said shoe on the other side of said shoe lacing with a flexible string wherein said strings are each of a length that does not interfere with or inhibit the conducting of steps (a)-(h).

* * * * *